US009939117B1

(12) United States Patent
Peng

(10) Patent No.: US 9,939,117 B1
(45) Date of Patent: Apr. 10, 2018

(54) LIGHT EMITTING DIODE SYSTEM WITH LIGHT SIGNALS CARRIED VIA POWER LINES

(71) Applicant: Semisilicon Technology Corp., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 0 days.

(21) Appl. No.: 15/848,748

(22) Filed: Dec. 20, 2017

Related U.S. Application Data

(63) Continuation-in-part of application No. 15/455,564, filed on Mar. 10, 2017.

(51) Int. Cl.
*H05B 37/00* (2006.01)
*F21S 4/10* (2016.01)
*H05B 33/08* (2006.01)

(52) U.S. Cl.
CPC ..... *F21S 4/10* (2016.01); *H05B 33/0842* (2013.01)

(58) Field of Classification Search
CPC ..... H05B 33/0803; H05B 33/0827; H05B 33/0809; H05B 33/0821; H05B 41/34; H05B 39/09; H05B 41/28; H05B 37/029; H05B 37/0254; H05B 37/02; H05B 33/0818; F21Y 2101/02
See application file for complete search history.

(56) References Cited

U.S. PATENT DOCUMENTS

| | | | | |
|---|---|---|---|---|
| 6,856,102 | B1 | 2/2005 | Lin et al. | |
| 8,836,224 | B2 | 9/2014 | Chen et al. | |
| 9,544,974 | B2 * | 1/2017 | Kang | H05B 37/0209 |
| 2014/0111101 | A1 | 4/2014 | McRae | |
| 2015/0382420 | A1 * | 12/2015 | Sakai | H05B 33/0803 315/193 |
| 2016/0309555 | A1 * | 10/2016 | Kang | H05B 33/0815 |

* cited by examiner

*Primary Examiner* — Minh D A
(74) *Attorney, Agent, or Firm* — Muncy, Geissler, Olds & Lowe, P.C.

(57) ABSTRACT

A light emitting diode system includes a light emitting diode lamp string, a signal voltage unit and a control unit. The light emitting diode lamp string includes a plurality of light emitting diode units. The control unit drives the signal voltage unit to adjust a voltage of the light emitting diode lamp string continuously and repeatedly so the voltage of the light emitting diode lamp string is a predetermined voltage, to form a light signal comprising a plurality of pulse waves to send the light signal to the light emitting diode lamp string. When each of the light emitting diode units receives the light signal, each of the light emitting diode units performs a conversion and a decoding for the light signal to obtain a lighting mode of the light signal, and then each of the light emitting diode units lights based on the lighting mode.

18 Claims, 9 Drawing Sheets

LIGHT EMITTING DIODE SYSTEM WITH LIGHT SIGNALS CARRIED VIA POWER LINES

CROSS REFERENCE TO RELATED APPLICATION

This application is a Continuation-in-Part of co-pending application Ser. No. 15/455,564, filed on Mar. 10, 2017. The entire contents of which are hereby incorporated by reference.

BACKGROUND OF THE INVENTION

Field of the Invention

The present invention relates to a light emitting diode system, and especially relates to a light emitting diode system with light signals carried via power lines.

Description of the Related Art

For the existing light emitting diode lamp string generating the light signals, the additional light signal generation circuit has to be arranged to generate the light signals carried via power lines. Arranging the additional light signal generation circuit will result in the additional cost problem. Therefore, how to effectively reduce the cost of the additional light signal generation circuit is the goal of the current technology.

SUMMARY OF THE INVENTION

In order to solve the above-mentioned problems, an object of the present invention is to provide a light emitting diode system with light signals carried via power lines.

In order to achieve the object of the present invention mentioned above, the light emitting diode system of the present invention includes a light emitting diode lamp string, a signal voltage unit and a control unit. The light emitting diode lamp string comprises a plurality of light emitting diode units and receives power supplied through the power lines to light. The signal voltage unit is electrically connected to the light emitting diode lamp string. The control unit is electrically connected to the signal voltage unit. The control unit is configured to drive the signal voltage unit to adjust a voltage of the light emitting diode lamp string continuously and repeatedly so the voltage of the light emitting diode lamp string is a predetermined voltage, to form the light signal comprising a plurality of pulse waves to send the light signal to the light emitting diode lamp string. When each of the light emitting diode units receives the light signal, each of the light emitting diode units is configured to perform a conversion and a decoding for the light signal to obtain a lighting mode of the light signal, and then each of the light emitting diode units is configured to light based on the lighting mode.

The advantage of the present invention is to generate the light signals easily to drive the light emitting diodes to perform changing lighting. Therefore, the cost of the light signal generation circuit is saved.

Please refer to the detailed descriptions and figures of the present invention mentioned below for further understanding the technology, method and effect disclosed by the present invention to achieve the predetermined purpose of the present invention. The purpose, features and characteristics of the present invention can be understood well and in details. However, the figures are only for references and descriptions, but the present invention is not limited by the figures.

DETAILED DESCRIPTION OF THE INVENTION

Please refer to following detailed description and figures for the technical content of the present invention.

Figure 1:
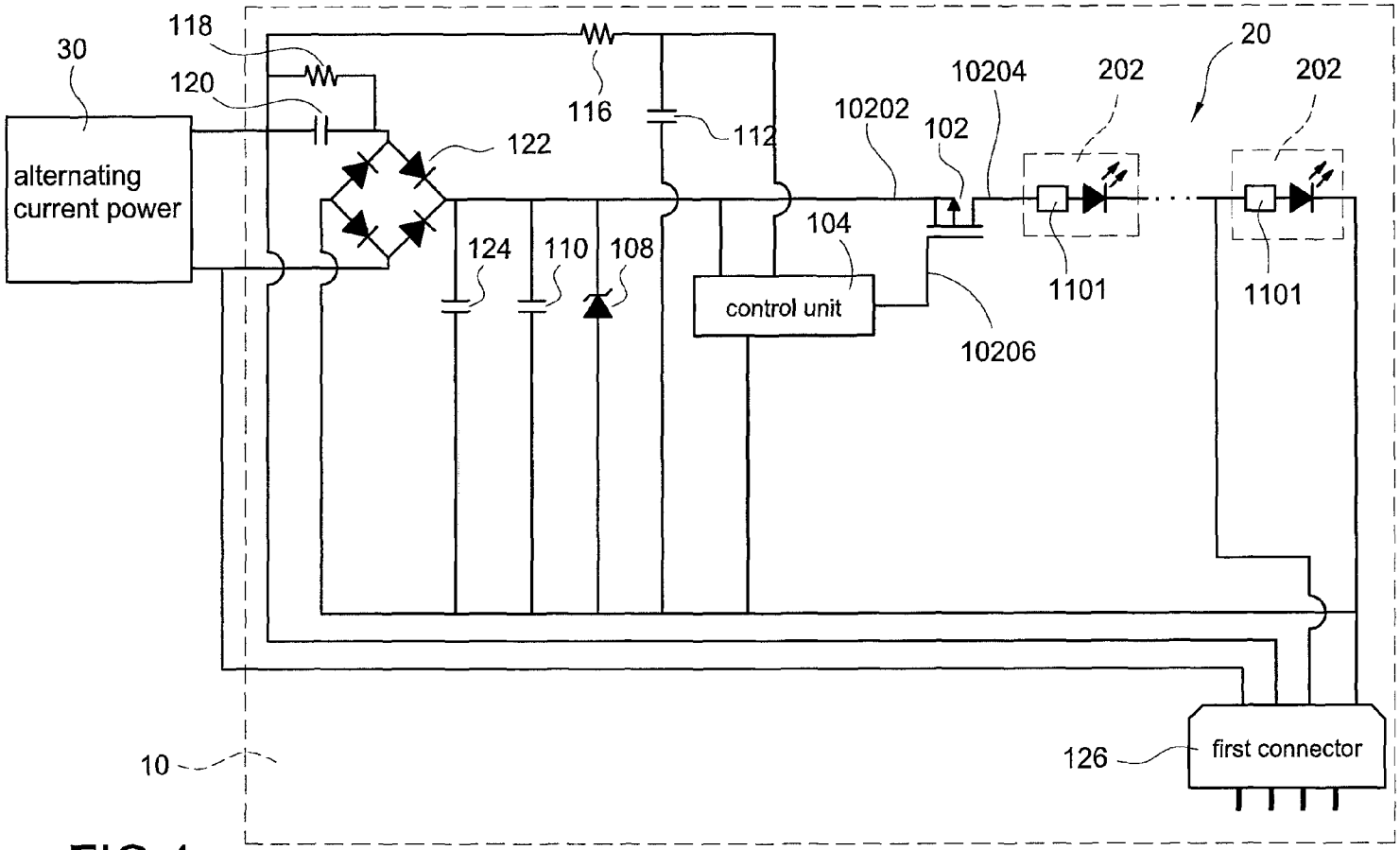
FIG. 1 shows a block diagram of the first embodiment of the light emitting diode system of the present invention.

FIG. 1 shows a block diagram of the first embodiment of the light emitting diode system of the present invention. A light emitting diode system 10 having light signals carried via power lines of the present invention is applied to an alternating current power 30. The light emitting diode system 10 comprises a light emitting diode lamp string 20, a signal voltage unit 102, a control unit 104, a first resistor 116, a first capacitor 110, a Zener diode 108, a second capacitor 112, a third capacitor 124, an input side resistor 118, an input side capacitor 120, an alternating-current-to-direct-current converter 122 and a first connector 126. The light emitting diode lamp string 20 comprises a plurality of light emitting diode units 202 and receives power supplied through the power lines to light. The signal voltage unit 102 comprises a power input side 10202, a power output side 10204 and a controlled side 10206. The elements mentioned above are electrically connected to each other. In an embodiment, the present invention only requires the signal voltage unit 102 and the control unit 104 to achieve the efficiency of the present invention.

The control unit 104 is configured to drive the signal voltage unit 102 to adjust a voltage of the light emitting diode lamp string 20 continuously and repeatedly so the voltage of the light emitting diode lamp string 20 is a predetermined voltage, to form the light signal comprising a plurality of pulse waves to send the light signal to the light emitting diode lamp string 20. When each of the light emitting diode units 202 receives the light signal, each of the light emitting diode units 202 is configured to perform a conversion and a decoding for the light signal to obtain a lighting mode of the light signal, and then each of the light emitting diode units 202 is configured to light based on the lighting mode.

In an embodiment of the present invention, the control unit 104 controls a conduction rate of the signal voltage unit 102 to change a voltage of the power output side 10204 to generate the light signal, and then the light emitting diode lamp string 20 receives the light signal to perform changing lighting. The light signal is used to control a lighting pattern of the light emitting diode lamp string 20. The light signal can comprise a plurality of pulse waves to drive the light emitting diode lamp string 20 to achieve various lighting patterns (for examples, changing colors, fast blinking, slowly blinking, marquee effect and so on). The light emitting diode units 202 are two-pin point-controlled lamps. The signal voltage unit 102 shown in FIG. 1 is a P type metal oxide semiconductor field effect transistor (P-MOSFET). However, the present invention does not limit the signal voltage unit 102. The control unit 104 is electrically connected to the controlled side 10206 and provides a control voltage to the controlled side 10206 to determine the conduction rate.

In the embodiment shown in FIG. 1, the electrical characteristics of the P type metal oxide semiconductor field effect transistor are utilized, and the control unit 104 sends a proper voltage to the gate of the P type metal oxide semiconductor field effect transistor to change the conduction rate of the P type metal oxide semiconductor field effect transistor to generate the light signal. Because the metal oxide semiconductor field effect transistor has the variable resistance characteristic which is regarded as having the linear resistance changing according to the changing of the conduction rate, the signal voltage unit 102 can have different resistance values by utilizing different conduction rates. Namely, the voltage of the power output side 10204 is changed to generate the light signal. The light signal comprises a plurality of the pulse waves. The signal voltage unit 102 changes the conduction rate of the signal voltage unit 102 to form the pulse wave each time. The embodiment of the light signal would be described in details in FIG. 6 later. The alternating current power 30 mentioned above sends an alternating current power to the elements mentioned above to perform the rectification, filtering, voltage clamping and so on.

Figure 2:
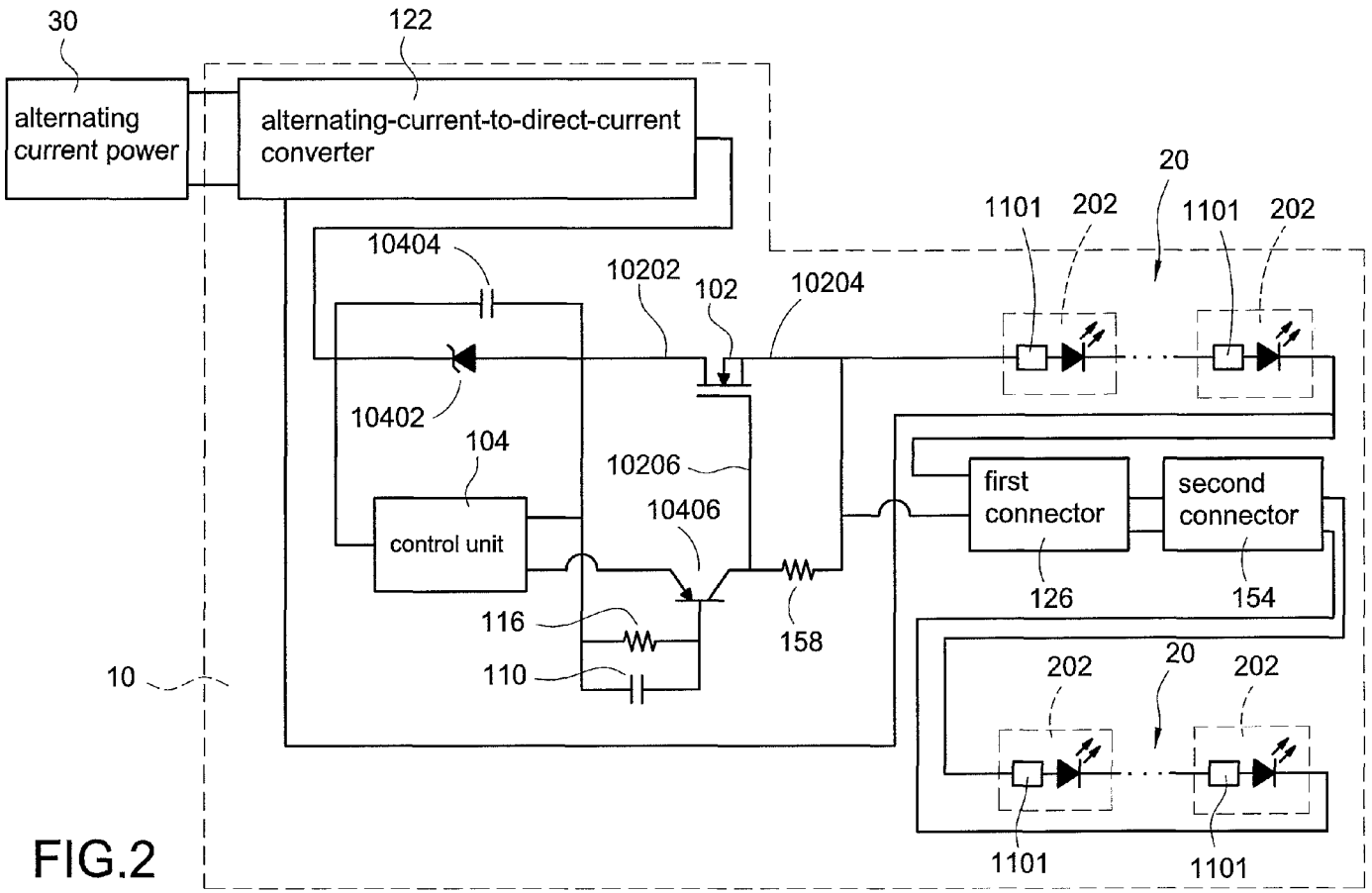
FIG. 2 shows a block diagram of the second embodiment of the light emitting diode system of the present invention.

FIG. 2 shows a block diagram of the second embodiment of the light emitting diode system of the present invention. The descriptions of the elements shown in FIG. 2 which are the same as the elements shown in FIG. 1 are not repeated here for brevity. Moreover, the light emitting diode system 10 further comprises a controlling side Zener diode 10402, a controlling side capacitor 10404, a first transistor 10406, an output side resistor 158 and a second connector 154. The elements mentioned above are electrically connected to each other. The signal voltage unit 102 shown in FIG. 2 is an N type metal oxide semiconductor field effect transistor (N-MOSFET) and its efficiency is the same as the efficiency of the P type metal oxide semiconductor field effect transistor shown in FIG. 1, so the description is not repeated here for brevity.

The controlling side Zener diode 10402 is used to supply power to the control unit 104. The related art control unit utilizes the voltage drop of the related art resistor as the driving voltage. However, because the input voltage is high, the temperature of the related art resistor is very high and dangerous. The controlling side Zener diode 10402 of the present invention replaces the related art resistor to supply power to the control unit 104 to avoid the high temperature of the related art resistor. The present invention utilizes the cathode reverse connection characters of the controlling side Zener diode 10402 and utilizes the reverse breakdown voltage, so that the driving voltage of the control unit 104 is supplied by reducing the original input high voltage. Namely, the present invention utilizes the stable voltage and current characters of the controlling side Zener diode 10402 to solve the high temperature problem of the related art.

The alternating-current-to-direct-current converter 122, the controlling side Zener diode 10402, the signal voltage unit 102 and the light emitting diode lamp string 20 are connected in series. The control unit 104, the controlling side Zener diode 10402 and the controlling side capacitor 10404 are connected in parallel. The method for fetching power for the control unit 104 of the present invention is that the controlling side Zener diode 10402 is connected to the light emitting diode lamp string 20 in series. The voltage is divided by the controlling side Zener diode 10402 and the light emitting diode lamp string 20, so that there is no temperature problem. The second connector 154 is connected to the first connector 126, so that the light emitting diode system 10 can comprise more light emitting diode lamp strings 20.

Figure 3:
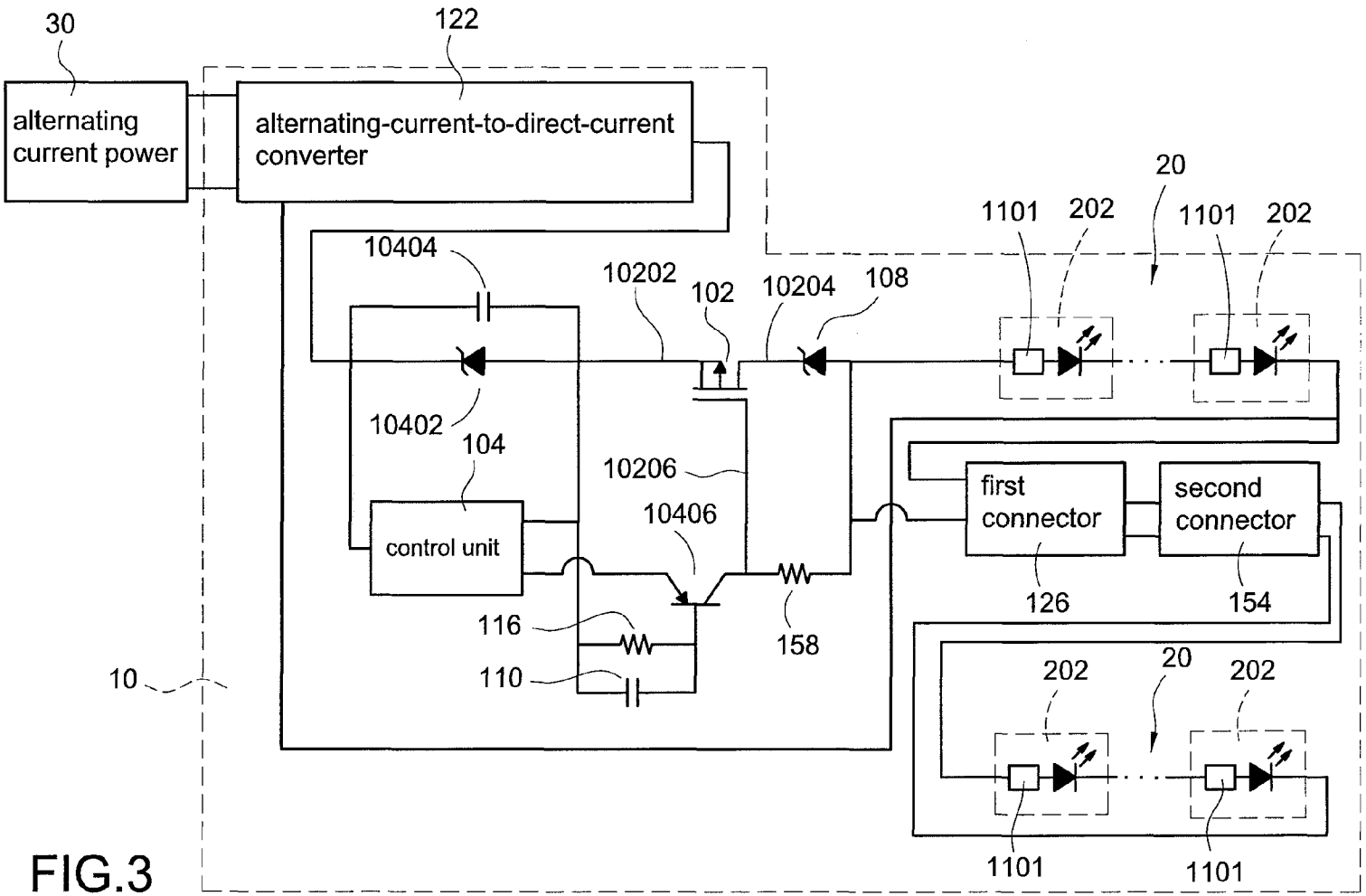
FIG. 3 shows a block diagram of the third embodiment of the light emitting diode system of the present invention.

FIG. 3 shows a block diagram of the third embodiment of the light emitting diode system of the present invention. The descriptions of the elements shown in FIG. 3 which are the same as the elements shown in FIGS. 1~2 are not repeated here for brevity. Moreover, the light emitting diode system 10 further comprises a controlling side Zener diode 10402, a controlling side capacitor 10404, a first transistor 10406, an output side resistor 158 and a second connector 154. The elements mentioned above are electrically connected to each other. The signal voltage unit 102 shown in FIG. 3 is a P type metal oxide semiconductor field effect transistor (P-MOSFET).

Figure 4:
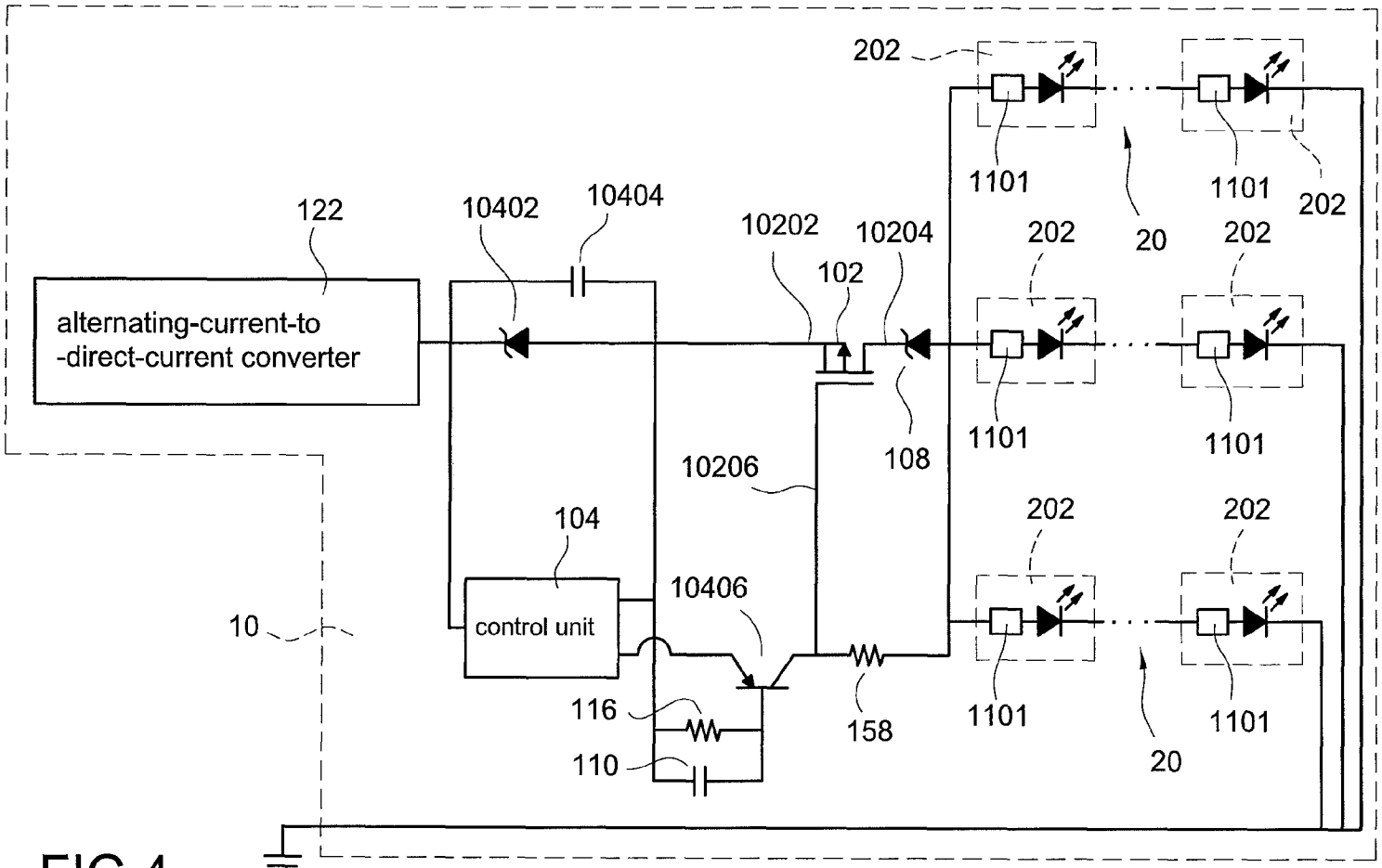
FIG. 4 shows a block diagram of the fourth embodiment of the light emitting diode system of the present invention.

FIG. 4 shows a block diagram of the fourth embodiment of the light emitting diode system of the present invention. The descriptions of the elements shown in FIG. 4 which are the same as the elements shown in FIGS. 1~3 are not repeated here for brevity. Moreover, the light emitting diode system 10 further comprises a controlling side Zener diode 10402, a controlling side capacitor 10404, a first transistor 10406 and an output side resistor 158. The elements mentioned above are electrically connected to each other. The signal voltage unit 102 shown in FIG. 4 is a P type metal oxide semiconductor field effect transistor (P-MOSFET).

Figure 5:
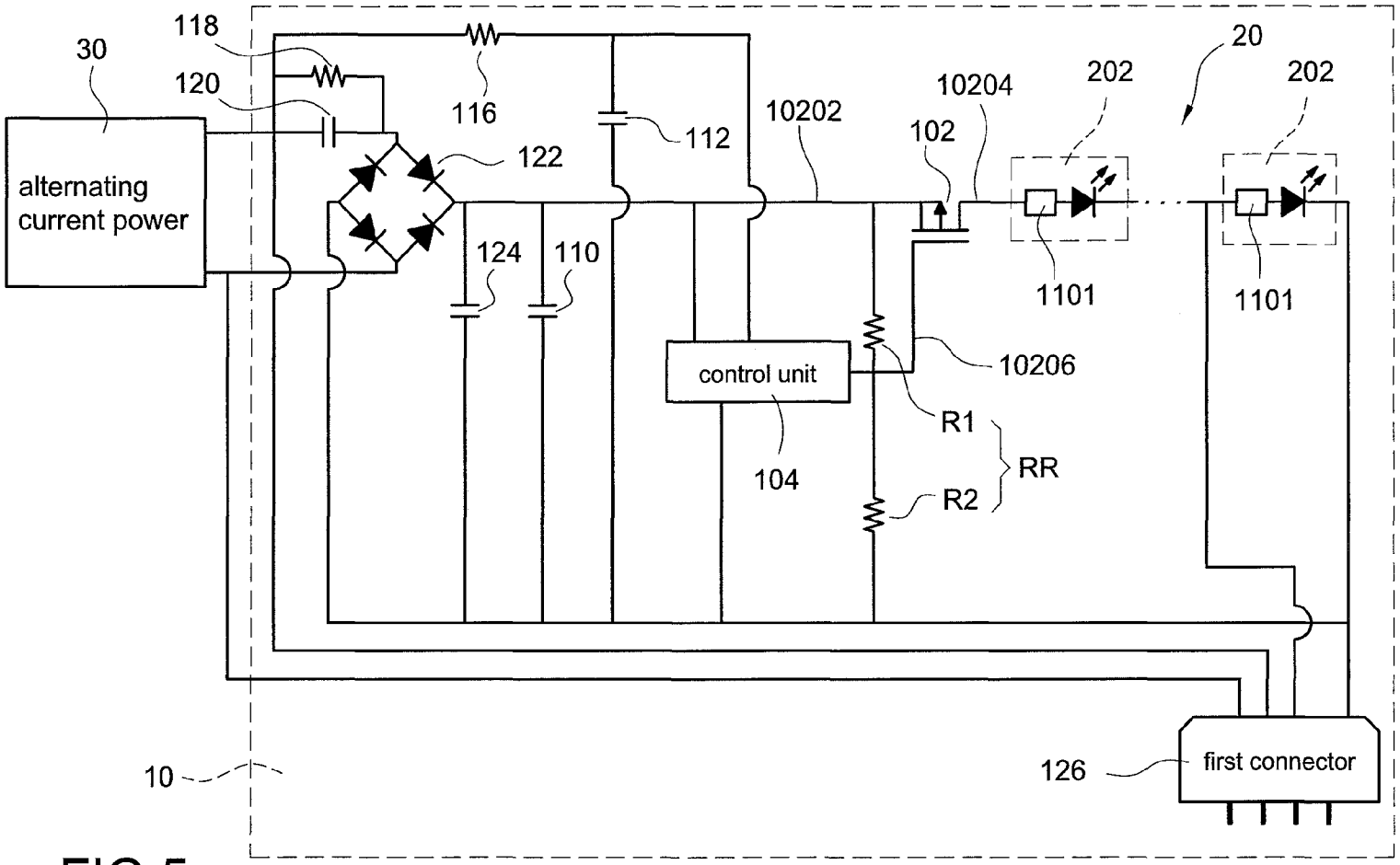
FIG. 5 shows a block diagram of the fifth embodiment of the light emitting diode system of the present invention.

FIG. 5 shows a block diagram of the fifth embodiment of the light emitting diode system of the present invention. The descriptions of the elements shown in FIG. 5 which are the same as the elements shown in FIGS. 1~4 are not repeated here for brevity. Moreover, the light emitting diode system 10 further comprises a voltage-dividing resistor circuit RR. The voltage-dividing resistor circuit RR comprises a first voltage-dividing resistor R1 and a second voltage-dividing resistor R2. The elements mentioned above are electrically connected to each other. The signal voltage unit 102 shown in FIG. 5 is a P type metal oxide semiconductor field effect transistor (P-MOSFET). The control unit 104 shown in FIG. 5 has an automatically voltage-decreasing function.

The control unit 104 utilizes the voltage-dividing resistor circuit RR (for example, the internal circuit of the control unit 104 renders that the connection point of the first voltage-dividing resistor R1 and the second voltage-dividing resistor R2 is connected to ground or not connected to ground) to generate the control voltage to determine the conduction rate. In the circuit design, according to the electrical characteristics of the signal voltage unit 102 (for example, the P type metal oxide semiconductor field effect transistor), the resistance values of the first voltage-dividing resistor R1 and the second voltage-dividing resistor R2 are determined. For example but the present invention is not limited to, the first voltage-dividing resistor R1 is 6000 ohms, the second voltage-dividing resistor R2 is 4000 ohms, and the conduction rate of the P type metal oxide semiconductor field effect transistor is fifty percent.

Figure 6:
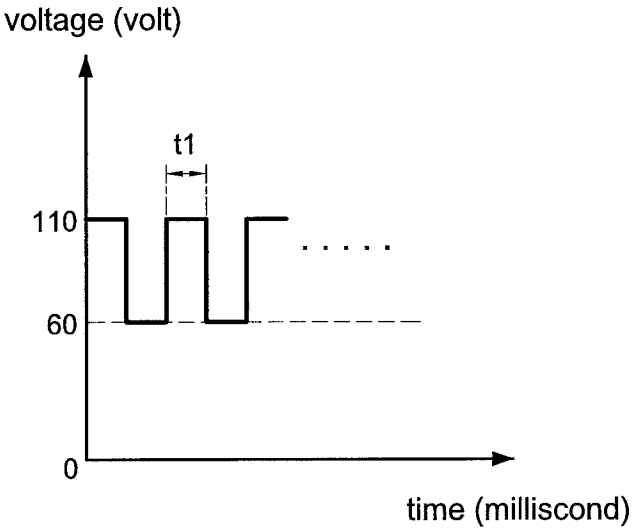
FIG. 6 shows a waveform diagram of an embodiment of the light signal of the present invention.

Please refer to FIG. 1 and FIG. 6 at the same time. FIG. 6 shows a waveform diagram of an embodiment of the light signal of the present invention. As shown in FIG. 6, in the normal condition, the control unit 104 controls the signal voltage unit 102 to be turned on completely and fully. At this time, the resistance value of the signal voltage unit 102 is the minimum, so that the voltage of the power output side 10204 is 110 volts. When the control unit 104 controls to decrease the conduction rate of the signal voltage unit 102 according to a predetermined voltage (for example, 60 volts), the voltage of the power output side 10204 is decreased as 60 volts. After that, the control unit 104 controls the signal voltage unit 102 to be turned on completely and fully again, so that the voltage is recovered to 110 volts again to form a pulse wave. According to the control unit 104 each time changing and recovering the conduction rate of the signal voltage unit 102, a plurality of the pulse waves are generated to be combined as the light signal. Moreover, a duration t1 is between each pulse wave. The light emitting diode lamp string 20 receives the light signal to utilize the pulse waves to perform changing lighting.

Moreover, when the light emitting diode lamp string 20 receives the light signal, each light emitting diode unit 202 can utilize a first signal to determine and interpret the meaning of the light signal to perform changing lighting, wherein the first signal comprises the pulse waves meeting the predetermined voltage. Namely, the pulse wave is regarded as the digital signal "1" and the duration t1 is regarded as the digital signal "0". A plurality of the digital signals "1" and "0" are combined as the light signal to drive the light emitting diode unit 202 to perform changing lighting. In another embodiment, the light emitting diode unit 202 utilizes the quantity of the duration t1 to determine and interpret the meaning of the light signal to perform changing lighting. Namely, the pulse wave is regarded as the digital signal "0" and the duration t1 is regarded as the digital signal "1". In this embodiment, the pulse waves do not need to meet the predetermined voltage.

The present invention determines the duration t1 mentioned above, so that the present invention does not have the related art problems. The present invention can improve the ability to determine and interpret the light signal to increase the accuracy.

Moreover, the light emitting diode unit 202 mentioned above comprises an address and data identifier 1101 to perform the conversion and the decoding for the light signal. The address and data identifier 1101 receives the light signal and converts the light signal into digital signals to drive the light emitting diode unit 202 to light, glimmer or flash colorfully or sparklingly, or light fade-in and fade-out.

Moreover, in an embodiment of the present invention, the signal voltage unit 102 is a switch electrically connected to a positive side of the light emitting diode lamp string 20. In another embodiment of the present invention, the signal voltage unit 102 is electrically connected to a negative side of the light emitting diode lamp string 20, as shown in following FIGS. 7-9.

Figure 7:
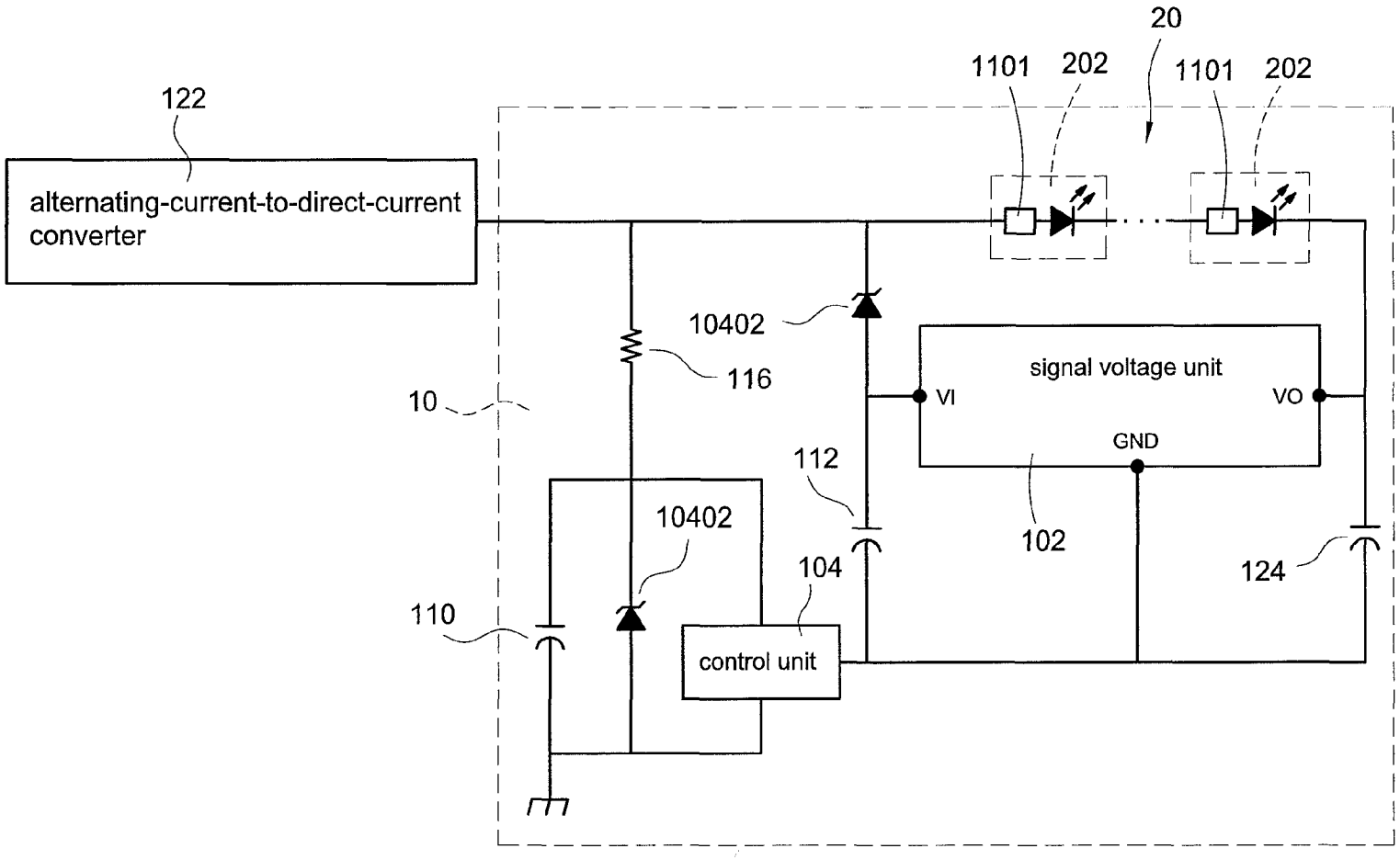
FIG. 7 shows a block diagram of the sixth embodiment of the light emitting diode system of the present invention.

FIG. 7 shows a block diagram of the sixth embodiment of the light emitting diode system of the present invention. The elements shown in FIG. 7, which are similar to the elements shown in all figures mentioned above, are not repeated here for brevity. Moreover, the signal voltage unit 102 comprises a voltage input side VI, a voltage output side VO and a first side GND. The light emitting diode system 10 further comprises a first resistor 116, a first capacitor 110, a controlling side Zener diode 10402, a Zener diode 108, a second capacitor 112 and a third capacitor 124. The first resistor 116 is electrically connected to the control unit 104. The first capacitor 110 is electrically connected to the control unit 104. The controlling side Zener diode 10402 is electrically connected to the control unit 104. The Zener diode 108 is electrically connected to the voltage input side VI of the signal voltage unit 102. The second capacitor 112 is electrically connected to voltage input side VI of the signal voltage unit 102. The third capacitor 124 is electrically connected to the voltage output side VO of the signal voltage unit 102.

The signal voltage unit 102 sends a first voltage through the voltage output side VO to the negative side of the light emitting diode lamp string 20. When the control unit 104 sends a control signal to the signal voltage unit 102 and the control signal is a high-level voltage, a voltage of the negative side of the light emitting diode lamp string 20 is the first voltage and the high-level voltage. When the control unit 104 sends the control signal to the signal voltage unit 102 and the control signal is a low-level voltage, the voltage of the negative side of the light emitting diode lamp string 20 is the first voltage and the low-level voltage. Therefore, the voltage of the negative side of the light emitting diode lamp string 20 has high-low changes.

Figure 8:
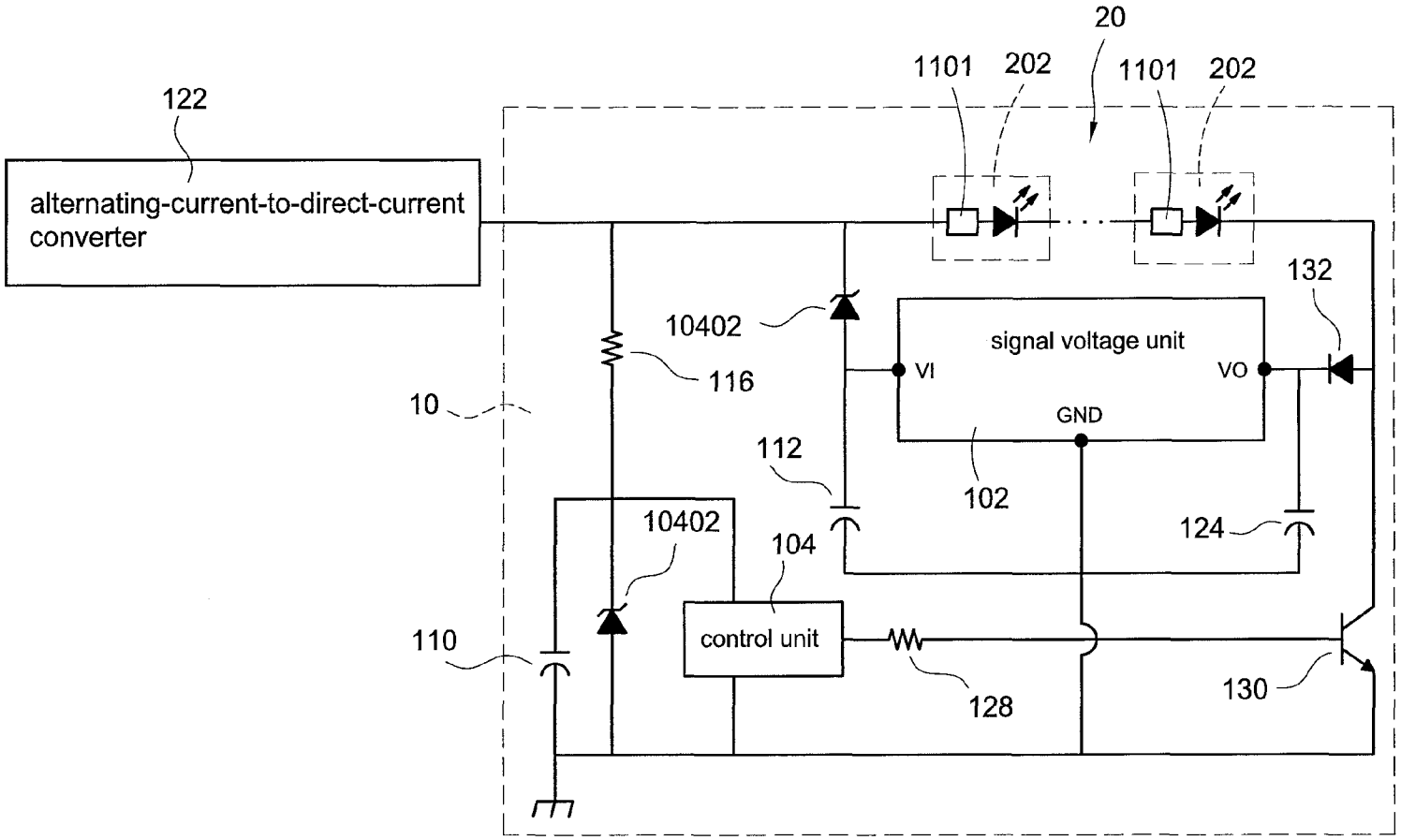
FIG. 8 shows a block diagram of the seventh embodiment of the light emitting diode system of the present invention.

FIG. 8 shows a block diagram of the seventh embodiment of the light emitting diode system of the present invention. The elements shown in FIG. 8, which are similar to the elements shown in all figures mentioned above, are not repeated here for brevity. Moreover, the light emitting diode system 10 further comprises a second resistor 128, a second transistor 130 and a first diode 132. The second resistor 128 is electrically connected to the control unit 104. The second transistor 130 is electrically connected to the second resistor 128. The first diode 132 is electrically connected to the voltage output side VO of the signal voltage unit 102.

When the control unit 104 sends a control signal to the second transistor 130 and the control signal is a high-level voltage (to turn on the second transistor 130), the negative side of the light emitting diode lamp string 20 is connected to ground. When the control unit 104 sends the control signal to the second transistor 130 and the control signal is a low-level voltage (to turn off the second transistor 130), a voltage of the negative side of the light emitting diode lamp string 20 is a first voltage which is provided by the signal voltage unit 102 through the voltage output side VO. Therefore, the voltage of the negative side of the light emitting diode lamp string 20 has high-low changes.

Figure 9:
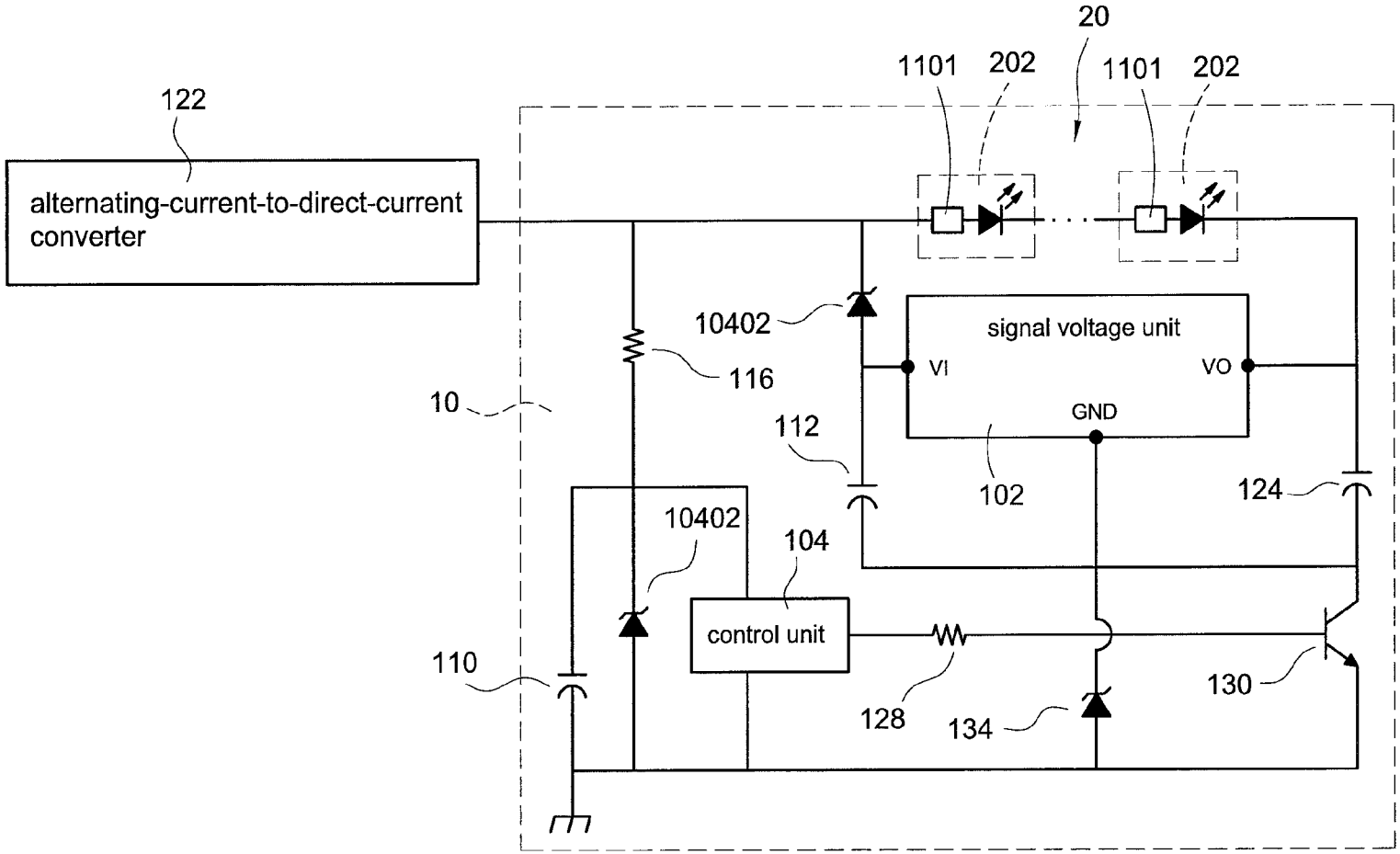
FIG. 9 shows a block diagram of the eighth embodiment of the light emitting diode system of the present invention.

FIG. 9 shows a block diagram of the eighth embodiment of the light emitting diode system of the present invention. The elements shown in FIG. 9, which are similar to the elements shown in all figures mentioned above, are not repeated here for brevity. Moreover, the light emitting diode system 10 further comprises a regulator side Zener diode 134 electrically connected to the first side GND of the signal voltage unit 102.

The signal voltage unit 102 sends a first voltage through the voltage output side VO to the negative side of the light emitting diode lamp string 20. When the control unit 104 sends a control signal to the second transistor 130 and the control signal is a high-level voltage (to turn on the second transistor 130), a voltage of the negative side of the light emitting diode lamp string 20 is the first voltage. When the control unit 104 sends the control signal to the second transistor 130 and the control signal is a low-level voltage (to turn off the second transistor 130), the voltage of the negative side of the light emitting diode lamp string 20 is the first voltage and a Zener voltage which is provided by the regulator side Zener diode 134. Therefore, the voltage of the negative side of the light emitting diode lamp string 20 has high-low changes.

The advantage of the present invention is to generate the light signals easily to drive the light emitting diodes to perform changing lighting. Therefore, the cost of the light signal generation circuit is saved.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode system with light signals carried via power lines, the light emitting diode system comprising:

a light emitting diode lamp string comprising a plurality of light emitting diode units and receiving power supplied through the power lines to light;

a signal voltage unit electrically connected to the light emitting diode lamp string; and a control unit electrically connected to the signal voltage unit, wherein the control unit is configured to drive the signal voltage unit to adjust a voltage of the light emitting diode lamp string continuously and repeatedly so the voltage of the light emitting diode lamp string is a predetermined voltage, to form the light signal comprising a plurality of pulse waves to send the light signal to the light emitting diode lamp string; when each of the light emitting diode units receives the light signal, each of the light emitting diode units is configured to perform a conversion and a decoding for the light signal to obtain a lighting mode of the light signal, and then each of the light emitting diode units is configured to light based on the lighting mode.

2. The light emitting diode system in claim 1, wherein the control unit is configured to provide a control voltage to the signal voltage unit to determine a conduction rate of the signal voltage unit.

3. The light emitting diode system in claim 1 further comprising:

a controlling side zener diode electrically connected to the control unit, wherein the controlling side zener diode is used to supply power to the control unit; the controlling side zener diode, the signal voltage unit and the light emitting diode lamp string are connected in series.

4. The light emitting diode system in claim 1 further comprising:

a voltage-dividing resistor circuit electrically connected to the signal voltage unit and the control unit, wherein the control unit utilizes the voltage-dividing resistor circuit to generate a control voltage to determine a conduction rate of the signal voltage unit.

5. The light emitting diode system in claim 4, wherein the voltage-dividing resistor circuit comprises:

a first voltage-dividing resistor electrically connected to the signal voltage unit and the control unit; and a second voltage-dividing resistor electrically connected to the signal voltage unit, the control unit and the first voltage-dividing resistor.

6. The light emitting diode system in claim 1, wherein the light signal comprises the pulse waves meeting the predetermined voltage; a duration is between each pulse wave; the light emitting diode lamp string receives the light signal to utilize the pulse waves to perform changing lighting.

7. The light emitting diode system in claim 1, wherein a duration is between each pulse wave; the light emitting diode lamp string receives the light signal to utilize the duration to perform changing lighting.

8. The light emitting diode system in claim 1 further comprising:

a first resistor electrically connected to the control unit;

a first capacitor electrically connected to the control unit;

a zener diode electrically connected to the signal voltage unit;

a second capacitor electrically connected to the control unit;

a third capacitor electrically connected to the control unit;

an input side resistor electrically connected to the first resistor; and an input side capacitor electrically connected to the first resistor.

9. The light emitting diode system in claim 1 further comprising:

a controlling side capacitor electrically connected to the control unit;

a first transistor electrically connected to the control unit; and an output side resistor electrically connected to the first transistor and the signal voltage unit.

10. The light emitting diode system in claim 3 further comprising:

an alternating-current-to-direct-current converter electrically connected to the control unit, wherein the alternating-current-to-direct-current converter, the controlling side zener diode, the signal voltage unit and the light emitting diode lamp string are connected in series.

11. The light emitting diode system in claim 1 further comprising:

a first connector electrically connected to the control unit and the light emitting diode lamp string; and a second connector electrically connected to the first connector.

12. The light emitting diode system in claim 1, wherein the light emitting diode unit comprises an address and data identifier; the address and data identifier is configured to receive the light signal and convert the light signal into digital signals to drive the light emitting diode unit to light, glimmer or flash colorfully or sparklingly, or light fade-in and fade-out.

13. The light emitting diode system in claim 1, wherein the signal voltage unit is a switch electrically connected to a positive side of the light emitting diode lamp string.

14. The light emitting diode system in claim 1, wherein the signal voltage unit is electrically connected to a negative side of the light emitting diode lamp string.

15. The light emitting diode system in claim 14, wherein the signal voltage unit comprises a voltage input side, a voltage output side and a first side; wherein the light emitting diode system further comprises:

a first resistor electrically connected to the control unit;

a first capacitor electrically connected to the control unit;

a controlling side zener diode electrically connected to the control unit;

a zener diode electrically connected to the voltage input side of the signal voltage unit;

a second capacitor electrically connected to voltage input side of the signal voltage unit; and a third capacitor electrically connected to the voltage output side of the signal voltage unit.

16. The light emitting diode system in claim 15 further comprising:

a second resistor electrically connected to the control unit; and a second transistor electrically connected to the second resistor.

17. The light emitting diode system in claim 16 further comprising:

a first diode electrically connected to the voltage output side of the signal voltage unit.

18. The light emitting diode system in claim 16 further comprising:

a regulator side zener diode electrically connected to the first side of the signal voltage unit.

* * * * *